US009924744B2

(12) United States Patent
Lin

(10) Patent No.: US 9,924,744 B2
(45) Date of Patent: Mar. 27, 2018

(54) ELECTRONIC CIGARETTE HAVING THREE CONNECTION PORTIONS

(71) Applicant: SHENZHEN HAPPY VAPING TECHNOLOGY LIMITED, Shenzhen, Guangdong (CN)

(72) Inventor: Guangrong Lin, Guangdong (CN)

(73) Assignee: SHENZHEN HAPPY VAPING TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 15/321,198

(22) PCT Filed: Dec. 4, 2014

(86) PCT No.: PCT/CN2014/093009
§ 371 (c)(1),
(2) Date: Dec. 22, 2016

(87) PCT Pub. No.: WO2015/196737
PCT Pub. Date: Dec. 30, 2015

(65) Prior Publication Data

US 2017/0150754 A1 Jun. 1, 2017

(30) Foreign Application Priority Data

Jun. 25, 2014 (CN) ..... 2014 2 0341430 U

(51) Int. Cl.
*A24F 47/00* (2006.01)
*H05B 3/03* (2006.01)

(52) U.S. Cl.
CPC ..... *A24F 47/008* (2013.01); *H05B 3/03* (2013.01); *H05B 2203/021* (2013.01)

(58) Field of Classification Search
None
See application file for complete search history.

(56) References Cited

U.S. PATENT DOCUMENTS

2013/0192617 A1* 8/2013 Thompson ..... A24F 47/008 131/329
2013/0319407 A1* 12/2013 Liu ..... A61M 15/06 128/202.21

(Continued)

FOREIGN PATENT DOCUMENTS

CN 201430916 Y 3/2010
CN 203314099 U 12/2013

OTHER PUBLICATIONS

International Search Report of PCT Patent Application No. PCT/CN2014/093009 dated Mar. 24, 2015.

*Primary Examiner* — Tho D Ta

(57) ABSTRACT

Disclosed is an electronic cigarette, wherein a first connection portion (1) is arranged at an end of a casing tube (101) of a battery stick (10) adjacent to a vaporizer assembly, a second connection portion (2) is arranged at an end of a vaporizer tube body (201) adjacent to the battery stick (10), a third connection portion (3) is arranged at an end of a casing tube (30) of a vaporizer (20) adjacent to the battery stick (10). The second connection portion (2) and the first connection portion (1) abut against each other to be connected, the third connection portion (3) is detachably connected to the first connection portion (1) by means of a screw thread.

10 Claims, 4 Drawing Sheets

(56) References Cited

U.S. PATENT DOCUMENTS

2014/0060556 A1* 3/2014 Liu ..... A24F 47/008
131/329
2014/0373833 A1* 12/2014 Liu ..... A61M 11/042
128/202.21
2015/0335072 A1* 11/2015 Giller ..... F21V 33/0004
131/328

* cited by examiner

ELECTRONIC CIGARETTE HAVING THREE CONNECTION PORTIONS

FIELD OF THE INVENTION

The present invention relates to an electronic cigarette.

BACKGROUND OF THE INVENTION

Existing electronic cigarettes usually comprise a battery stick, a vaporizer and a mouth piece, wherein the vaporizer and a casing tube of the vaporizer are designed as an integral one-piece construction that has to be integrally replaced with a new one when cigarette liquid in the vaporizer is exhausted, which increases the costs for the manufacture and use of the vaporizer. In addition, the vaporizer and the battery stick are usually connected via a twist-lock connection structure or snap-fit connection structure, such connection structures are complicated and are thus inconvenient for the disassembly and replacement of the vaporizer, which worsens the user experience.

SUMMARY OF THE INVENTION

The present invention aims to provide an electronic cigarette designed to have a vaporizer and a casing tube of the vaporizer as two separate parts and have a simplified connection structure between the vaporizer and a battery stick. The electronic cigarette of the present application greatly reduces the costs for the manufacture and use of the vaporizer, and meanwhile facilitates the disassembly and replacement of the vaporizer, which improves the user experience.

The technical solution of the present application is an electronic cigarette comprising a battery stick, a vaporizer assembly and a mouth piece that are connected together, wherein the battery stick comprises a battery, a casing tube of the battery stick for sheathing the battery, and a first connection portion arranged at an end of the casing tube of the battery stick adjacent to the vaporizer assembly; the vaporizer assembly comprises a vaporizer, and a casing tube of the vaporizer for sheathing the vaporizer in an inner cavity of the casing tube; the vaporizer comprises a vaporizer tube body, and a second connection portion arranged at an end of the vaporizer tube body adjacent to the battery stick; a third connection portion is arranged at an end of the casing tube of the vaporizer adjacent to the battery stick; the second connection portion and the first connection portion abut against each other to be connected, the third connection portion is detachably connected to the first connection portion by means of a screw thread.

In this embodiment, the first connection portion comprises a first connection seat having an outer thread and serving as a negative electrode electrically connected to a negative electrode of the battery, a first positive electrode arranged at a centre of the first connection seat and electrically connected to a positive electrode of the battery, and a first insulation sleeve placed between the first positive electrode and the first connection seat; the second connection portion comprises a second connection seat serving as a negative electrode electrically connected to a heating coil of the vaporizer, a second positive electrode arranged at a centre of the second connection seat and electrically connected to the heating coil of the vaporizer, and a second insulation sleeve placed between the second positive electrode and the second connection seat; the second positive electrode has a central through hole along an axial direction of the second positive electrode for intercommunicating with a vaporizing cavity of the vaporizer, an end surface of the second positive electrode has a transversal groove along a radial direction of the end surface for intercommunicating with the central through hole; the third connection portion has an inner thread engaging with the outer thread of the first connection seat; the first positive electrode and the second positive electrode abut against each other to be electrically connected, the first connection seat and the second connection seat are electrically connected.

In this embodiment, the first connection seat has a step-like shape, a protruding step is formed at a middle portion of the first connection seat that has a maximum outer diameter; one side of the protruding step is provided with a first cylindrical wall having an outer diameter smaller than that of the protruding step, the first cylindrical wall is sheathed with an inner wall of said end of the casing tube of the battery stick, the outer diameter of the protruding step equals an outer diameter of the casing tube of the battery stick; the other side of the protruding step is provided with a second cylindrical wall having an outer diameter smaller than that of the protruding step and having the outer thread, one end of the second cylindrical wall is provided with a base wall having a central through hole, the central through hole is configured for installing the first positive electrode and the first insulation sleeve.

In this embodiment, the second connection seat is a cylindrical body having a protruding platform at one end thereof; an outer wall of the cylindrical body is sheathed with an inner wall of said end of the vaporizer tube body; an inner wall at a lower portion of the second connection seat is provided with a base wall, a tubular body is protruded from a center of the base wall, the tubular body is provided with a central through hole for installing the second insulation sleeve and the second positive electrode.

In this embodiment, the outer wall of the cylindrical body is provided with a circular groove configured for mounting a sealing ring.

In this embodiment, an outer diameter of the protruding platform is larger than an outer diameter of the vaporizer tube body; a bottom of the inner thread of the third connection portion has at least one airflow hole communicating with an air inlet hole opened in the casing tube of the vaporizer; the bottom of the inner thread of the third connection portion further has a protruding ring inwardly and radially protruding from an inner wall of the third connection portion; the protruding platform of the second connection seat terminates on the protruding ring of the third connection portion when the vaporizer is sheathed with the casing tube of the vaporizer.

In another embodiment, the first connection seat has a step-like shape, a protruding step is formed at a middle portion of the first connection seat that has a maximum outer diameter; one side of the protruding step is provided with a first cylindrical wall having an outer diameter smaller than that of the protruding step, the first cylindrical wall is sheathed with an inner wall of said end of the casing tube of the battery stick, the outer diameter of the protruding step equals an outer diameter of the casing tube of the battery stick; the other side of the protruding step of the first connection seat is provided with a second cylindrical wall and a third cylindrical wall, an outer diameter of the third cylindrical wall is smaller than an outer diameter of the second cylindrical wall, the outer diameter of the second cylindrical wall is smaller than the outer diameter of the protruding step of the first connection seat; the second cylindrical wall has the outer thread; the outer diameter of the third cylindrical wall is smaller than an inner diameter of the cylindrical body of the second connection seat; the third cylindrical wall has at least one air passage hole; an inner wall at a bottom of the third cylindrical wall is provided with a base wall, the base wall is provided with a central through hole configured for installing the first positive electrode and the first insulation sleeve.

In this embodiment, an inner wall of the third cylindrical wall has an inner thread configured for connecting to a connector of a battery charger.

The technical solutions of the present invention have advantages as follows. The electronic cigarette of the present invention is designed to have the vaporizer and the casing tube of the vaporizer as two separate parts, therefore the costs for the manufacture and use of the vaporizer is greatly reduced. In addition, the vaporizer and the battery stick abut against each other to be connected. After unscrewing the casing tube of the vaporizer, the vaporizer can be easily taken off. Thus it is very convenient for the disassembly and replacement of the vaporizer, which improves the user experience.

LIST OF REFERENCE NUMERALS OF MAIN COMPONENTS

Figure 1:
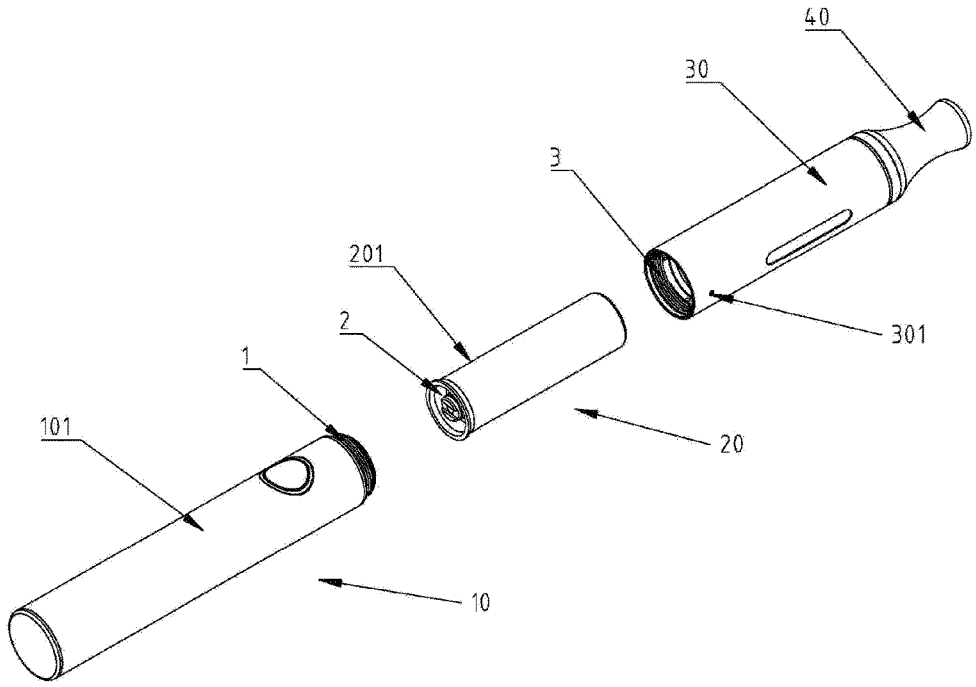
FIG. 1 is a perspective exploded view of an electronic cigarette according to an embodiment of the present invention.

10 battery stick
101 casing tube of battery stick
20 vaporizer
201 vaporizer tube body
30 casing tube of vaporizer
301 air inlet hole
40 mouth piece
1 first connection portion
11 first connection seat
111 protruding step
112 first cylindrical wall
113 second cylindrical wall
114 outer thread
115 base wall
116 central through hole
117 third cylindrical wall
118 air passage hole
119 inner thread
12 first positive electrode
13 first insulation sleeve
2 second connection portion
21 second connection seat
211 protruding platform
212 cylindrical body
213 base wall
214 tubular body
215 central through hole
216 circular groove
22 second positive electrode
23 second insulation sleeve
3 third connection portion
31 inner thread
32 airflow hole

DETAILED DESCRIPTION OF ILLUSTRATED EMBODIMENTS

Various preferred embodiments will now be described with reference to the figures.

FIGS. 1-6 show an electronic cigarette according to an embodiment of the present invention.

Referring to FIG. 1, the electronic cigarette comprises a battery stick 10, a vaporizer assembly (not shown in Figures), and a mouth piece 40 that are connected together. The battery stick 10 comprises a battery (not shown in Figures), a casing tube 101 of the battery stick 10 for sheathing the battery, and a first connection portion 1 arranged at an end of the casing tube 101 of the battery stick 10 adjacent to the vaporizer assembly. The vaporizer assembly comprises a vaporizer 20, and a casing tube 30 of the vaporizer 20 for sheathing the vaporizer 20 in an inner cavity of the casing tube 30. The vaporizer 20 comprises a vaporizer tube body 201, and a second connection portion 2 arranged at an end of the vaporizer tube body 201 adjacent to the battery stick 10. A third connection portion 3 is arranged at an end of the casing tube 30 of the vaporizer 20 adjacent to the battery stick 10. The second connection portion 2 and the first connection portion 1 abut against each other to be connected, the third connection portion 3 is detachably connected to the first connection portion 1 by means of a screw thread.

Referring to FIGS. 2, 3, 4, 5 and 6, the first connection portion 1 comprises a first connection seat 11 having an outer thread 114 and serving as a negative electrode electrically connected to a negative electrode of the battery, a first positive electrode 12 arranged at a centre of the first connection seat 11 and electrically connected to a positive electrode of the battery, and a first insulation sleeve 13 placed between the first positive electrode 12 and the first connection seat 11. The second connection portion 2 comprises a second connection seat 21 serving as a negative electrode electrically connected to a heating coil of the vaporizer 20, a second positive electrode 22 arranged at a centre of the second connection seat 21 and electrically connected to the heating coil of the vaporizer 20, and a second insulation sleeve 23 placed between the second positive electrode 22 and the second connection seat 21. The second positive electrode 22 has a central through hole 221 along an axial direction of the second positive electrode 22 for intercommunicating with a vaporizing cavity of the vaporizer 20, an end surface of the second positive electrode 22 has a transversal groove 222 along a radial direction of the end surface for intercommunicating with the central through hole 221. The third connection portion 3 has an inner thread 31 engaging with the outer thread 114 of the first connection seat 11. The first positive electrode 12 and the second positive electrode 22 abut against each other to be electrically connected, the first connection seat 11 and the second connection seat 21 are electrically connected.

It should be understood that the first connection seat 11 and the second connection seat 21 both can be served as positive electrodes, while the first positive electrode 12 and the second positive electrode 22 both can be served as negative electrodes. It should be understand that the first connection seat 11 and the second connection seat 21 may directly abut against each other to achieve the electrical connection therebetween, alternatively, the first connection seat 11 and the second connection seat 21 may not directly abut against each other but both connect to the third connection portion 3 made of metal to achieve the electrical connection therebetween.

Figure 2:
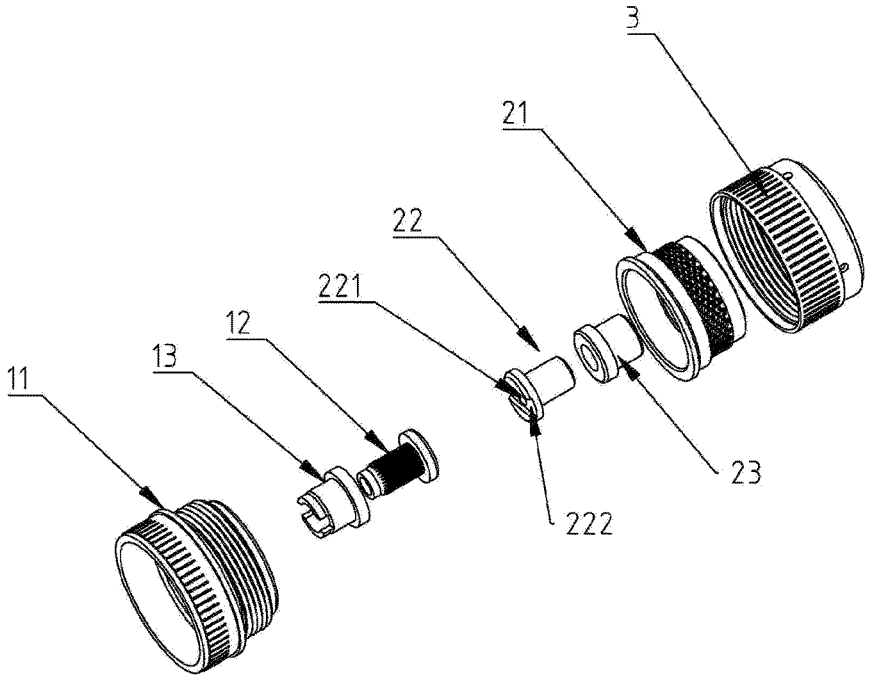
FIG. 2 is a perspective exploded view of three connection portions of an electronic cigarette according to an embodiment of the present invention.
Figure 3:
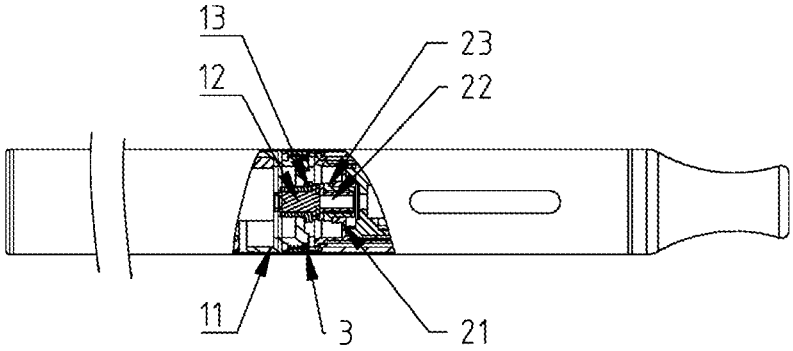
FIG. 3 is a cross-sectional view of three connection portions of an electronic cigarette according to an embodiment of the present invention.
Figure 4:
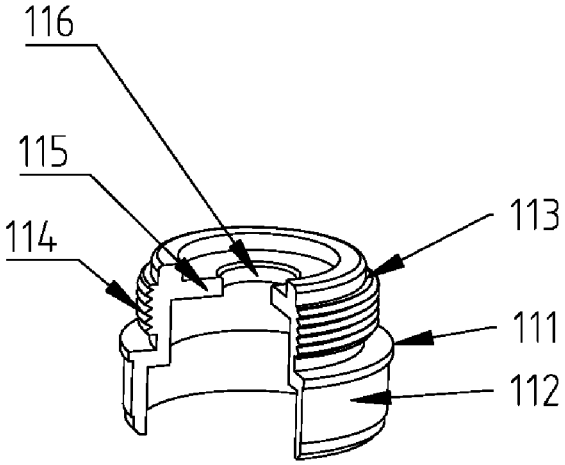
FIG. 4 is a schematic view showing a first connection seat of an electronic cigarette according to an embodiment of the present invention, with the first connection seat being partially sectioned.

Referring to FIGS. 2 and 4, the first connection seat 11 has a step-like shape, a protruding step 111 is formed at a middle portion of the first connection seat 11 that has a maximum outer diameter. One side of the protruding step 111 is provided with a first cylindrical wall 112 having an outer diameter smaller than that of the protruding step 111, the first cylindrical wall 112 is sheathed with an inner wall of said end of the casing tube 101 of the battery stick 10, the outer diameter of the protruding step 111 equals an outer diameter of the casing tube 101 of the battery stick 10. The other side of the protruding step 111 is provided with a second cylindrical wall 113 having an outer diameter smaller than that of the protruding step 111 and having the outer thread 114, one end of the second cylindrical wall 113 is provided with a base wall 115 having a central through hole 116, the central through hole 116 is configured for installing the first positive electrode 12 and the first insulation sleeve 13.

Figure 5:
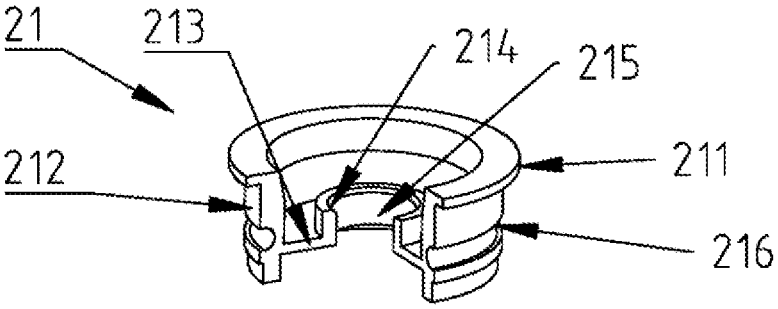
FIG. 5 is a schematic view showing a second connection seat of an electronic cigarette according to an embodiment of the present invention, with the second connection seat being partially sectioned.

Referring to FIGS. 2 and 5, the second connection seat 21 is a cylindrical body 212 having a protruding platform 211 at one end thereof. An outer wall of the cylindrical body 212 is sheathed with an inner wall of said end of the vaporizer tube body 201. An inner wall at a lower portion of the second connection seat 21 is provided with a base wall 213, a tubular body 214 is protruded from a center of the base wall 213, the tubular body 214 is provided with a central through hole 215 for-installing the second insulation sleeve 23 and the second positive electrode 22.

Preferably, the outer wall of the cylindrical body 212 is provided with a circular groove 216 configured for mounting a sealing ring, such that cigarette liquid in the vaporizer 20 will not leak when the outer wall of the cylindrical body 212 is sheathed with the inner wall of the end of the vaporizer tube body 201.

Figure 6:
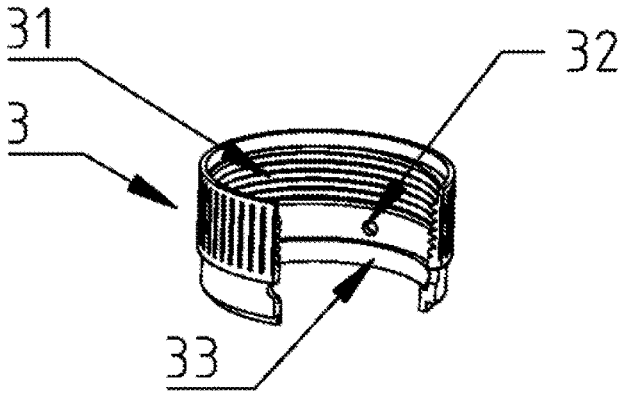
FIG. 6 is a schematic view showing a third connection portion of an electronic cigarette according to an embodiment of the present invention, with the third connection portion being partially sectioned.

Referring to FIGS. 2, 5 and 6, an outer diameter of the protruding platform 211 is larger than an outer diameter of the vaporizer tube body 201. A bottom of the inner thread 31 of the third connection portion 3 has at least one airflow hole 32 communicating with an air inlet hole 301 opened in the casing tube 30 of the vaporizer 20. The bottom of the inner thread 31 of the third connection portion 3 further has a protruding ring 33 inwardly and radially protruding from an inner wall of the third connection portion 3. The protruding platform 211 of the second connection seat 21 terminates on the protruding ring 33 of the third connection portion 3 when the vaporizer 20 is sheathed with the casing tube 30 of the vaporizer 20.

Figure 7:
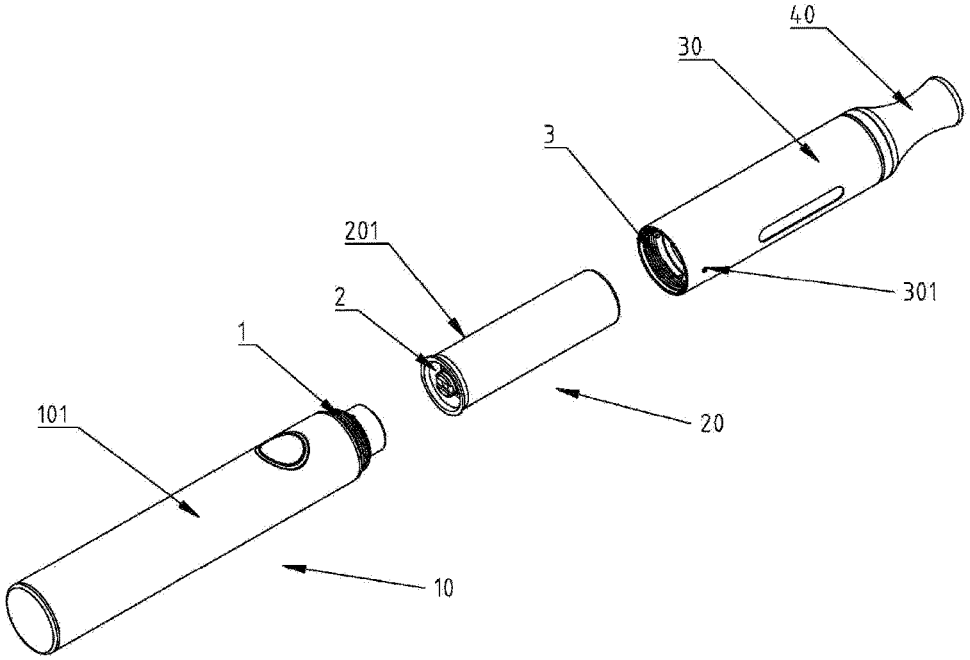
FIG. 7 is a perspective exploded view of an electronic cigarette according to another embodiment of the present invention.
Figure 8:
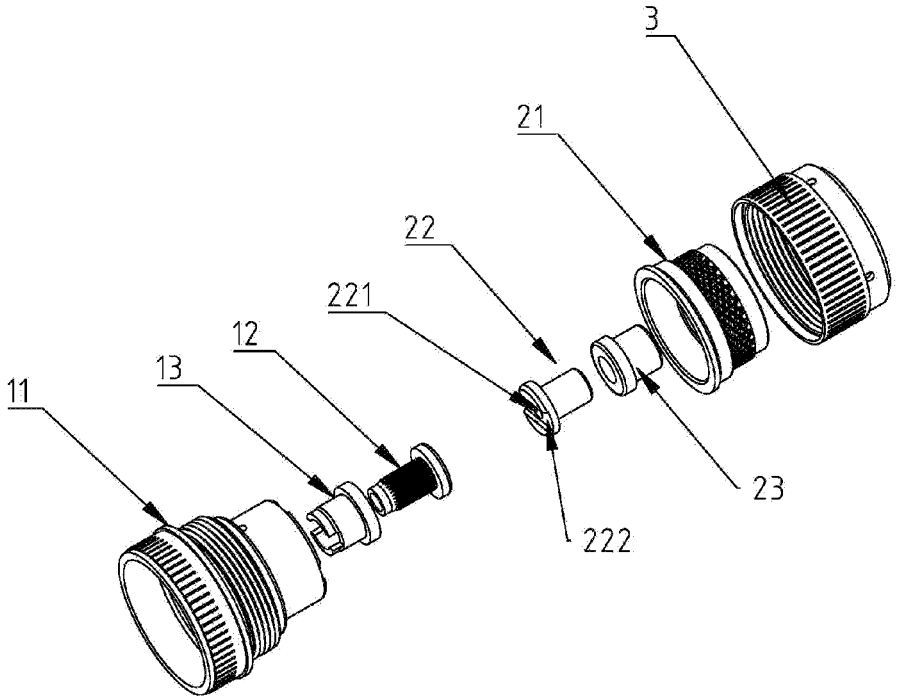
FIG. 8 is a perspective exploded view of three connection portions of an electronic cigarette according to another embodiment of the present invention.
Figure 9:
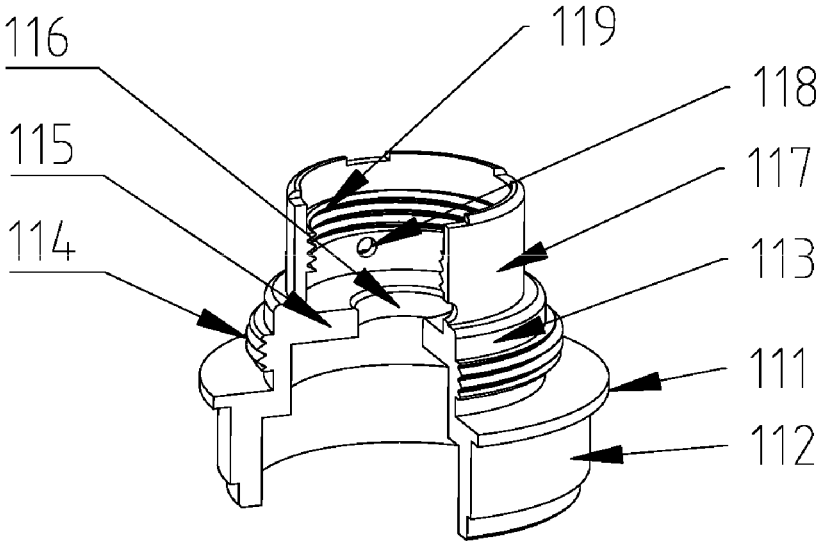
FIG. 9 is a schematic view showing a first connection seat of an electronic cigarette according to another embodiment of the present invention, with the first connection seat being partially sectioned.

FIGS. 7-9 show an electronic cigarette according to another embodiment of the present invention.

The technical solution of the embodiment differs from the aforesaid embodiment in that the first connection seat further comprises a third cylindrical wall. Referring to FIGS. 7, 8 and 9, the other side of the protruding step 111 of the first connection seat 11 is provided with a second cylindrical wall 113 and a third cylindrical wall 117, an outer diameter of the third cylindrical wall 117 is smaller than an outer diameter of the second cylindrical wall 113, the outer diameter of the second cylindrical wall 113 is smaller than an outer diameter of the protruding step 111 of the first connection seat 11. The second cylindrical wall 113 has the outer thread 114. The outer diameter of the third cylindrical wall 117 is smaller than an inner diameter of the cylindrical body 212 of the second connection seat 21. The third cylindrical wall 117 has at least one air passage hole 118. An inner wall at a bottom of the third cylindrical wall 117 is provided with a base wall 115, the base wall 115 is provided with a central through hole 116 configured for installing the first positive electrode 12 and the first insulation sleeve 13.

In this embodiment, an inner wall of the third cylindrical wall 117 has an inner thread 119 configured for connecting to a connector of a battery charger, such that a battery charger carrying an universal connector can easily charge the battery of the electronic cigarette of the present invention.

All the above are the preferred embodiments of the present invention, and the invention is intended to cover various modifications and equivalent arrangements included within the scope of the invention.

What is claimed is:

1. An electronic cigarette comprising a battery stick, a vaporizer assembly and a mouth piece that are connected together, characterized in that the battery stick comprises a battery, a casing tube of the battery stick for sheathing the battery, and a first connection portion arranged at an end of the casing tube of the battery stick adjacent to the vaporizer assembly;

the vaporizer assembly comprises a vaporizer, and a casing tube of the vaporizer for sheathing the vaporizer in an inner cavity of the casing tube;

the vaporizer comprises a vaporizer tube body, and a second connection portion arranged at an end of the vaporizer tube body adjacent to the battery stick;

a third connection portion is arranged at an end of the casing tube of the vaporizer adjacent to the battery stick;

the second connection portion and the first connection portion abut against each other to be connected, the third connection portion is detachably connected to the first connection portion by means of a screw thread;

the first connection portion comprises a first connection seat having an outer thread and serving as a negative electrode electrically connected to a negative electrode of the battery, a first positive electrode arranged at a center of the first connection seat and electrically connected to a positive electrode of the battery, and a first insulation sleeve placed between the first positive electrode and the first connection seat;

the second connection portion comprises a second connection seat serving as a negative electrode electrically connected to a heating coil of the vaporizer, a second positive electrode arranged at a center of the second connection seat and electrically connected to the heating coil of the vaporizer, and a second insulation sleeve placed between the second positive electrode and the second connection seat;

the second positive electrode has a central through hole along an axial direction of the second positive electrode for intercommunicating with a vaporizing cavity of the vaporizer, an end surface of the second positive electrode has a transversal groove along a radial direction of the end surface for intercommunicating with the central through hole;

the third connection portion has an inner thread engaging with the outer thread of the first connection seat;

the first positive electrode and the second positive electrode abut against each other to be electrically connected, the first connection seat and the second connection seat are electrically connected;

the first connection seat has a step-like shape, a protruding step is formed at a middle portion of the first connection seat that has a maximum outer diameter;

one side of the protruding step is provided with a first cylindrical wall having an outer diameter smaller than that of the protruding step, the first cylindrical wall is sheathed with an inner wall of said end of the casing tube of the battery stick, the outer diameter of the protruding step equals an outer diameter of the casing tube of the battery stick;

the other side of the protruding step is provided with a second cylindrical wall having an outer diameter smaller than that of the protruding step and having the outer thread, one end of the second cylindrical wall is provided with a base wall having a central through hole, the central through hole is configured for installing the first positive electrode and the first insulation sleeve.

2. The electronic cigarette according to claim 1, characterized in that the second connection seat is a cylindrical body having a protruding platform at one end thereof;

an outer wall of the cylindrical body is sheathed with an inner wall of said end of the vaporizer tube body;

an inner wall at a lower portion of the second connection seat is provided with a base wall, a tubular body is protruded from a center of the base wall, the tubular body is provided with a central through hole for installing the second insulation sleeve and the second positive electrode.

3. The electronic cigarette according to claim 2, characterized in that the first connection seat has a step-like shape, a protruding step is formed at a middle portion of the first connection seat that has a maximum outer diameter;

one side of the protruding step is provided with a first cylindrical wall having an outer diameter smaller than that of the protruding step, the first cylindrical wall is sheathed with an inner wall of said end of the casing tube of the battery stick, the outer diameter of the protruding step equals an outer diameter of the casing tube of the battery stick;

the other side of the protruding step of the first connection seat is provided with a second cylindrical wall and a third cylindrical wall, an outer diameter of the third cylindrical wall is smaller than an outer diameter of the second cylindrical wall, the outer diameter of the second cylindrical wall is smaller than the outer diameter of the protruding step of the first connection seat;

the second cylindrical wall has the outer thread;

the outer diameter of the third cylindrical wall is smaller than an inner diameter of the cylindrical body of the second connection seat;

the third cylindrical wall has at least one air passage hole;

an inner wall at a bottom of the third cylindrical wall is provided with a base wall, the base wall is provided with a central through hole configured for installing the first positive electrode and the first insulation sleeve.

4. The electronic cigarette according to claim 3, characterized in that an inner wall of the third cylindrical wall has an inner thread configured for connecting to a connector of a battery charger.

5. The electronic cigarette according to claim 2, characterized in that the outer wall of the cylindrical body is provided with a circular groove configured for mounting a sealing ring.

6. The electronic cigarette according to claim 4, characterized in that an outer diameter of the protruding platform is larger than an outer diameter of the vaporizer tube body;

a bottom of the inner thread of the third connection portion has at least one airflow hole communicating with an air inlet hole opened in the casing tube of the vaporizer;

the bottom of the inner thread of the third connection portion further has a protruding ring inwardly and radially protruding from an inner wall of the third connection portion;

the protruding platform of the second connection seat terminates on the protruding ring of the third connection portion when the vaporizer is sheathed with the casing tube of the vaporizer.

7. The electronic cigarette according to claim 5, characterized in that the first connection seat has a step-like shape, a protruding step is formed at a middle portion of the first connection seat that has a maximum outer diameter;

one side of the protruding step is provided with a first cylindrical wall having an outer diameter smaller than that of the protruding step, the first cylindrical wall is sheathed with an inner wall of said end of the casing tube of the battery stick, the outer diameter of the protruding step equals an outer diameter of the casing tube of the battery stick;

the other side of the protruding step of the first connection seat is provided with a second cylindrical wall and a third cylindrical wall, an outer diameter of the third cylindrical wall is smaller than an outer diameter of the second cylindrical wall, the outer diameter of the second cylindrical wall is smaller than the outer diameter of the protruding step of the first connection seat;

the second cylindrical wall has the outer thread;

the outer diameter of the third cylindrical wall is smaller than an inner diameter of the cylindrical body of the second connection seat;

the third cylindrical wall has at least one air passage hole;

an inner wall at a bottom of the third cylindrical wall is provided with a base wall, the base wall is provided with a central through hole configured for installing the first positive electrode and the first insulation sleeve.

8. The electronic cigarette according to claim 7, characterized in that an inner wall of the third cylindrical wall has an inner thread configured for connecting to a connector of a battery charger.

9. The electronic cigarette according to claim 6, characterized in that the first connection seat has a step-like shape, a protruding step is formed at a middle portion of the first connection seat that has a maximum outer diameter;

one side of the protruding step is provided with a first cylindrical wall having an outer diameter smaller than that of the protruding step, the first cylindrical wall is sheathed with an inner wall of said end of the casing tube of the battery stick, the outer diameter of the protruding step equals an outer diameter of the casing tube of the battery stick;

the other side of the protruding step of the first connection seat is provided with a second cylindrical wall and a third cylindrical wall, an outer diameter of the third cylindrical wall is smaller than an outer diameter of the second cylindrical wall, the outer diameter of the second cylindrical wall is smaller than the outer diameter of the protruding step of the first connection seat;

the second cylindrical wall has the outer thread;

the outer diameter of the third cylindrical wall is smaller than an inner diameter of the cylindrical body of the second connection seat;

the third cylindrical wall has at least one air passage hole;

an inner wall at a bottom of the third cylindrical wall is provided with a base wall, the base wall is provided with a central through hole configured for installing the first positive electrode and the first insulation sleeve.

10. The electronic cigarette according to claim 9, characterized in that an inner wall of the third cylindrical wall has an inner thread configured for connecting to a connector of a battery charger.

* * * * *